US006189477B1

(12) United States Patent
Cody

(10) Patent No.: US 6,189,477 B1
(45) **Date of Patent: *Feb. 20, 2001**

(54) MARINE ADVERTISING VESSEL

(76) Inventor: John J Cody, 302 Hubbard Ave, Stamford, CT (US) 06905

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/394,720

(22) Filed: Sep. 13, 1999

(51) Int. Cl.[7] ..... B63B 17/00

(52) U.S. Cl. ..... 114/343; 114/61.1; 114/123; 114/126; 40/592

(58) Field of Search ..... 114/343, 126, 114/253, 61.1, 123; D20/39; 40/592, 610, 646

(56) References Cited

U.S. PATENT DOCUMENTS

| | | | | |
|---|---|---|---|---|
| D. 65,103 | * | 7/1924 | Cusack | D20/39 |
| 2,055,369 | * | 9/1936 | Warren | 114/251 |
| 4,182,255 | * | 1/1980 | Reid | 114/126 |
| 5,357,895 | * | 10/1994 | Ceko | 114/343 |

* cited by examiner

*Primary Examiner*—Stephen Avila
(74) *Attorney, Agent, or Firm*—Patrick J. Walsh

(57) ABSTRACT

A marine advertising vessel comprises a floating member with superimposed deck supporting a display frame for mounting an advertising message or display well above water level to be readily visible along a shoreline. One or more vessels may be employed for an advertising display.

5 Claims, 5 Drawing Sheets

16f
16e
16f
26
26
16
A
22b
A
22
22a
14
14h
14a
24a
24a
24
24
14f
14g
14c
14f
14e
14b

MARINE ADVERTISING VESSEL

BACKGROUND OF THE INVENTION

The present invention relates to advertising and particularly to a marine platform for advertising along occupied shorelines.

A staple of summertime imagery is the picture of a crowded beach with a biplane towing a banner bearing a message of interest to beach goers. The airborne message is brief, distant, fleeting, and limited in form and content to a long streamer displaying a single line of text.

The present invention provides a marine advertising platform which can be moored or towed within easy viewing distance of shore, and which presents a large advertising area to enhance the advertising message being communicated.

SUMMARY OF THE INVENTION

In accordance with the invention, the marine advertising platform comprises a floating member with superimposed deck supporting a display frame for mounting an advertising message or display well above water line so as to be readily visible along a shoreline.

In a preferred embodiment of the invention, the floating member comprises a double hull of substantially similar hull components each with bow, stern, fixed keel, and elongate tubular mid-section. A generally rectangular deck bridges the hull components to form a floating vessel characterized by spaced, parallel hull components and by a deck bridging the hull components from bow to stern, and from port to starboard sides.

A taffrail extends along the outer perimeter of the deck.

Each hull member may be fitted with mud scows or outriggers to stabilize the hull in a waterway.

In a preferred form, a reticular display frame is fitted along the vessel centerline comprising a vertical bowmast rising from the bow, a vertical sternmast rising from the stern, a top beam extending fore and aft between the tops of the bow and stern masts, and a deck beam interconnecting the bow and stern masts just above the deck. The display frame extends a considerable distance above water line and provides a substantial rectangular area for mounting an advertising display.

The advertising display can be placed within the display frame at an angle of 90° with respect to the deck, or at a greater angle up to 120° to the deck as an aid to better visibility at greater distances of the display from shore.

Each marine vessel is preferably fitted with means for illuminating an advertising display, propulsion and steering means, couplings for towing and for linking a line of towed marine vessels each displaying a sequential component of a composite advertising display, and outrigger stabilizing devices.

OBJECTS OF THE INVENTION

An object of the invention is to provide a great marine advertising sign visible from long distances.

Another object of the invention is to provide a marine advertising sign permanently anchored at a certain distance from the coast.

Another object of the invention is to provide a marine advertising sign for movement along the coast.

Another object is to provide a marine vessel for mounting an advertising sign for display along a coast.

Another object is to provide a line of marine vessels for mounting components of a composite advertising sign for display along a coast.

Other and further objects of the invention will become apparent with an understanding of the following detailed description of the invention or upon employment of the invention in practice.

A preferred embodiment of the invention has been chosen for detailed description to enable those having ordinary skill in the art to which the invention appertains to readily understand how to construct and use the invention and is shown in the accompanying drawing in which.

DETAILED DESCRIPTION OF THE PREFERRED EMBODIMENT

Figure 1:
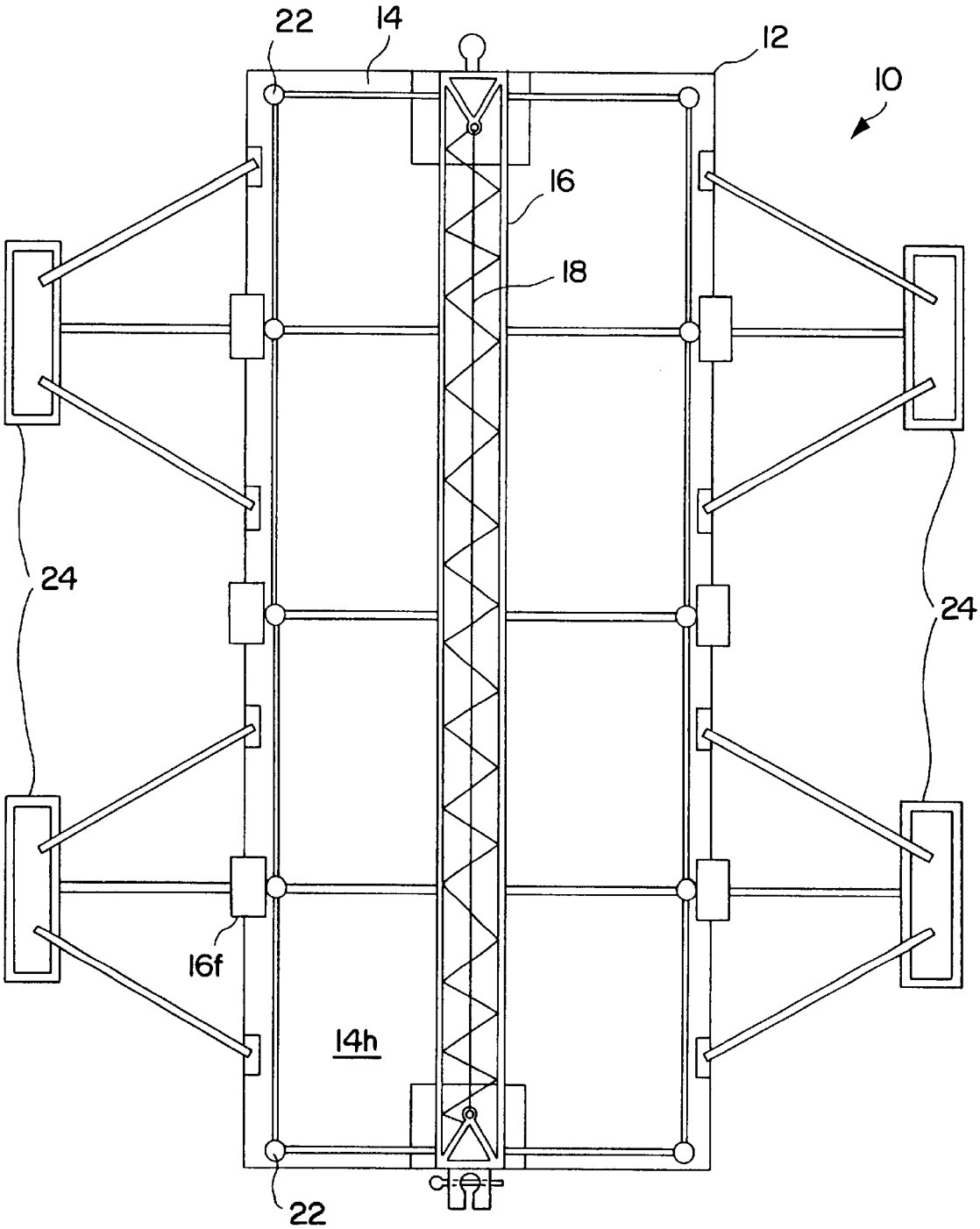
FIG. 1 is a plan view of a marine advertising vessel according to the invention.
Figure 2:
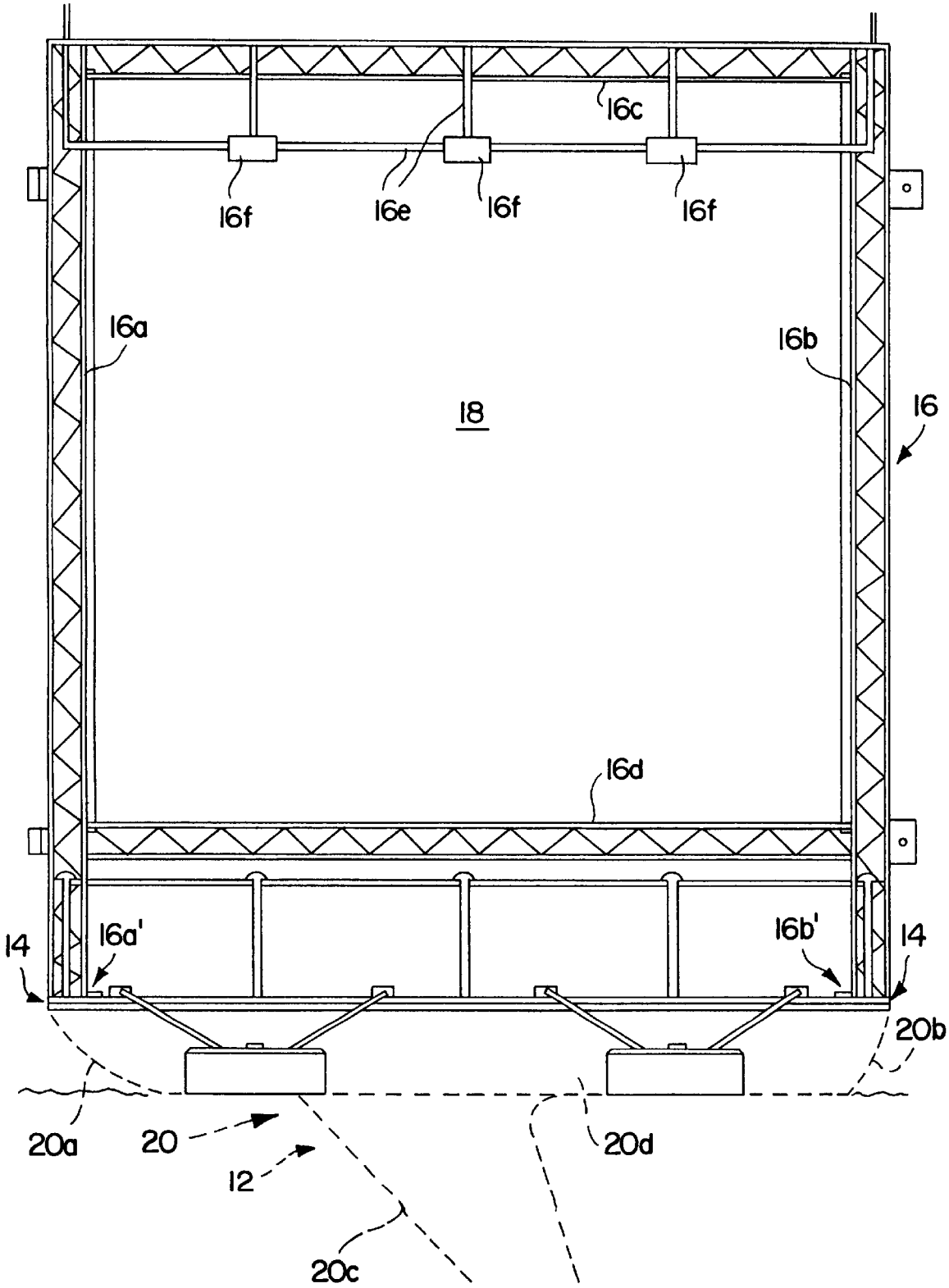
FIG. 2 is a side elevation view thereof.

Referring to the drawing, the marine advertising vessel 10 comprises a floating member 12 with superimposed deck 14 supporting a display frame 16 for mounting an advertising message or display 18 well above water level so as to be readily visible along a shoreline.

In a preferred embodiment of the invention, the floating member 12 comprises a double hull of substantially similar hull components 20 each with bow 20*a*, stern 20*b*, fixed keel 20*c*, and elongate tubular mid-section 20*d* in assembly with a generally rectangular deck 14 bridging the hull components to form the floating vessel. The deck substantially covers the hull components from bow to stern, and from port to starboard.

Figure 3:
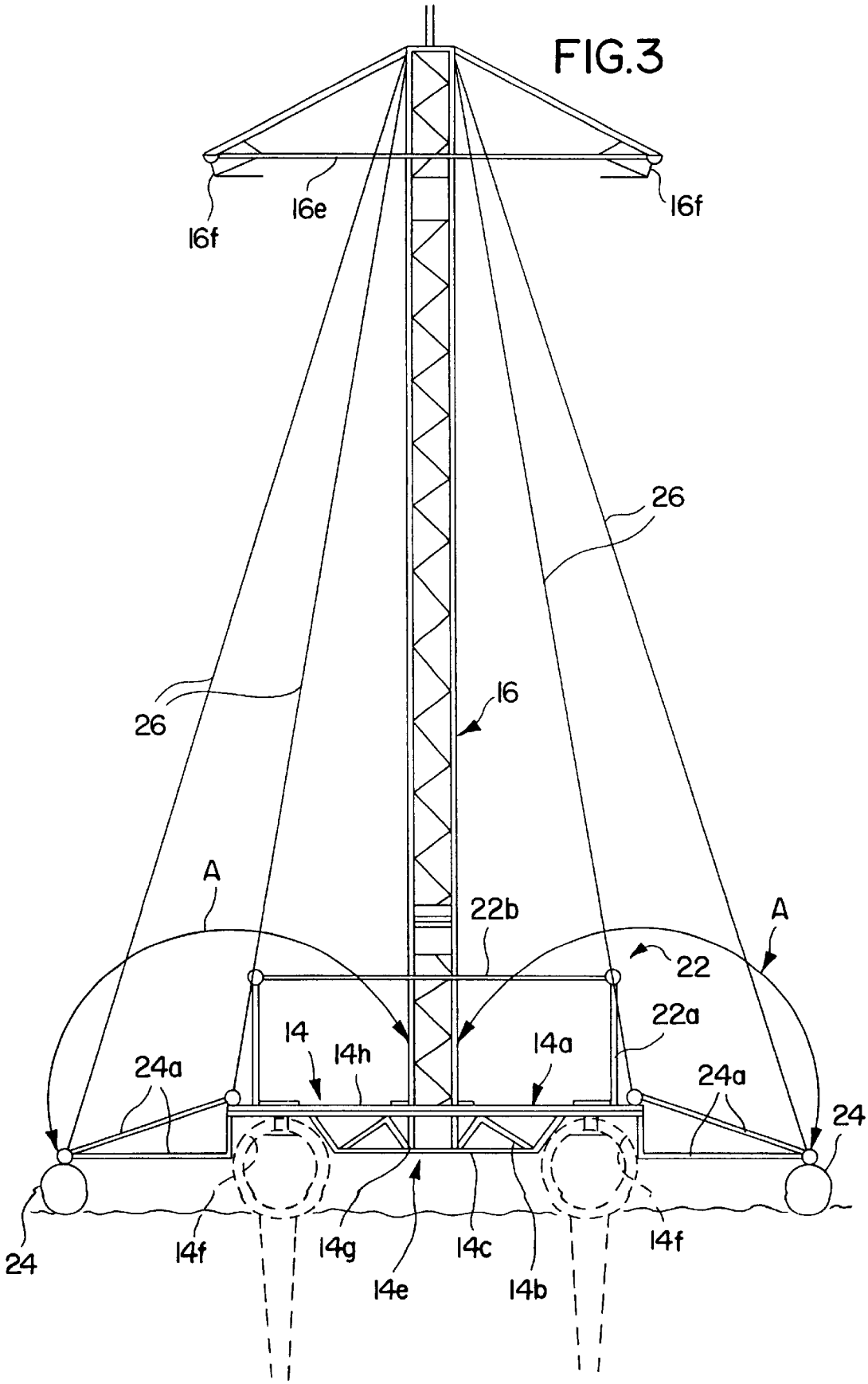
FIG. 3 is a stern view thereof.

The deck comprises an elongate structure 14*a* (FIG. 3) of struts 14*b* and beams 14*c* defining deck surface 14*d* and subdeck 14*e* with recesses 14*f* for accommodating hull members affixed to the deck structure by suitable means. The deck substructure 14*e* also defines a support base 14*g* for the display frame 16. The deck surface is finished with suitable planking or sheeting 14*h*.

A taffrail 22 with stanchions 22*a* and guard rails 22*b* extends along the outer perimeter of the deck.

Each hull member may be fitted fore and aft, port and starboard with mud scows 24 or outriggers to stabilize the hull in a waterway. A plurality of arms 24*a* extend from opposite sides of the deck to support the mud scows in operating position. Preferably, the mud scows are pivotally mounted to the vessel for deployment and storage as indicated by arrows A in FIG. 3.

In a preferred form, a reticular display frame 16 is fitted along the deck centerline comprising a vertical bowmast 16*a* rising from the bow, a vertical sternmast 16*b* rising from the stern, a top beam 16*c* extending fore and aft between the tops of the bow and stern masts, and a deck beam 16*d* interconnecting the bow and stern masts just above the deck. The base 16*a*', 16*b*' of each of the bowmast and stern mast is rigidly secured to the deck substructure 14*e*.

The display frame extends a considerable distance (approx. 7 meters) above water line and provides a substantial rectangular area for mounting an advertising display visible from port and starboard sides of the vessel. The top of the display frame is fitted with support rails 16*e* for mounting a light system 16*f* for illuminating an advertising display surface at night. One or more halogen lamps are fitted to the rails for illuminating each side of the display and are powered by suitable means such as solar panels, or by an electric generator of a towing vessel. The display frame may also include an audio system for broadcast in respect of the advertised message.

The advertising display is preferably a graphic design cloth that can be placed within the display frame at an angle of 90° with respect to the deck, or at a greater angle up to 120° to the deck as an aid to better visibility at greater distances of the display from shore.

Guys 26 provide for stability of the display frame masts.

Figure 4:
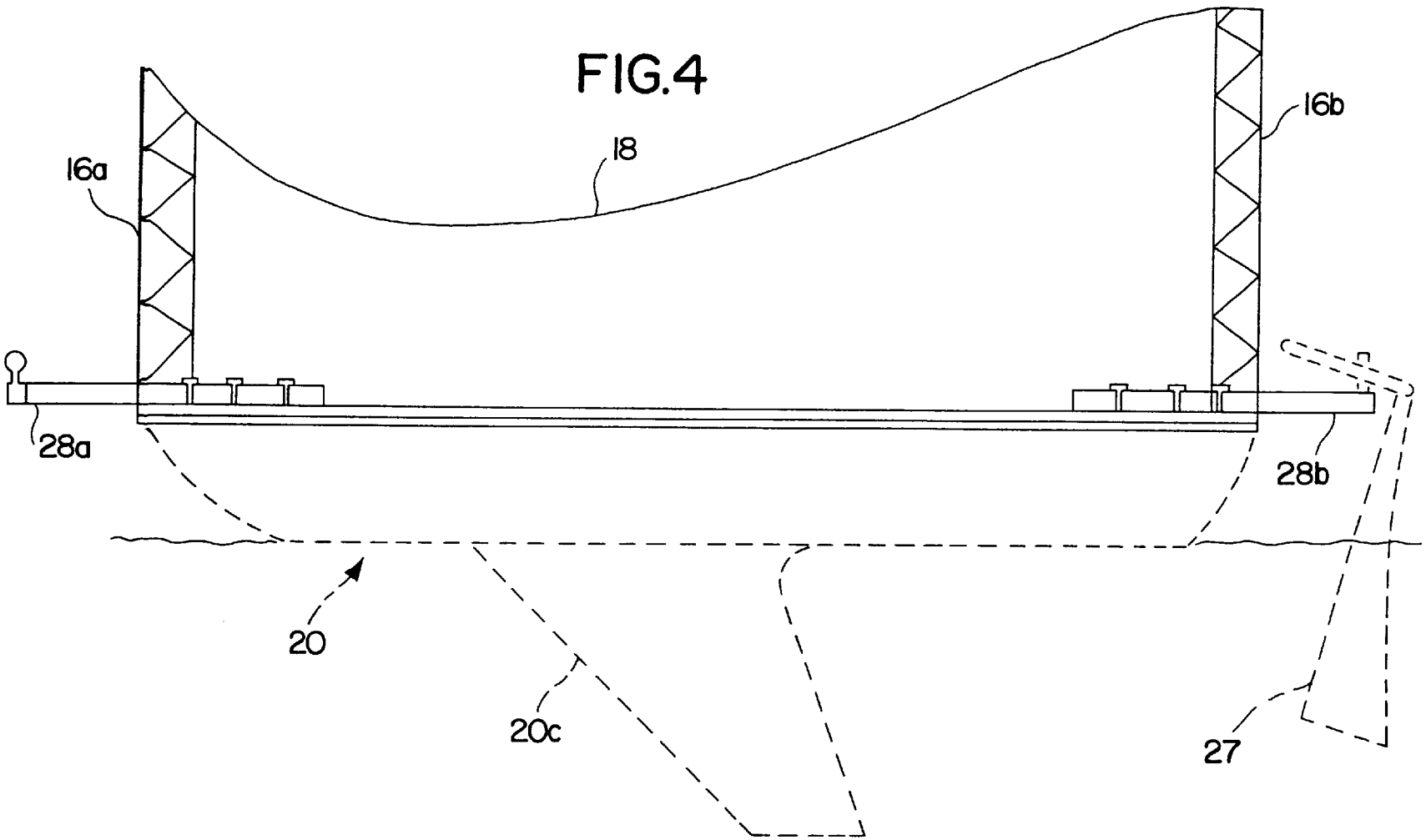
FIG. 4 is a fragmentary side elevation view of a modified vessel according to the invention showing towing and steering means.
Figure 5:
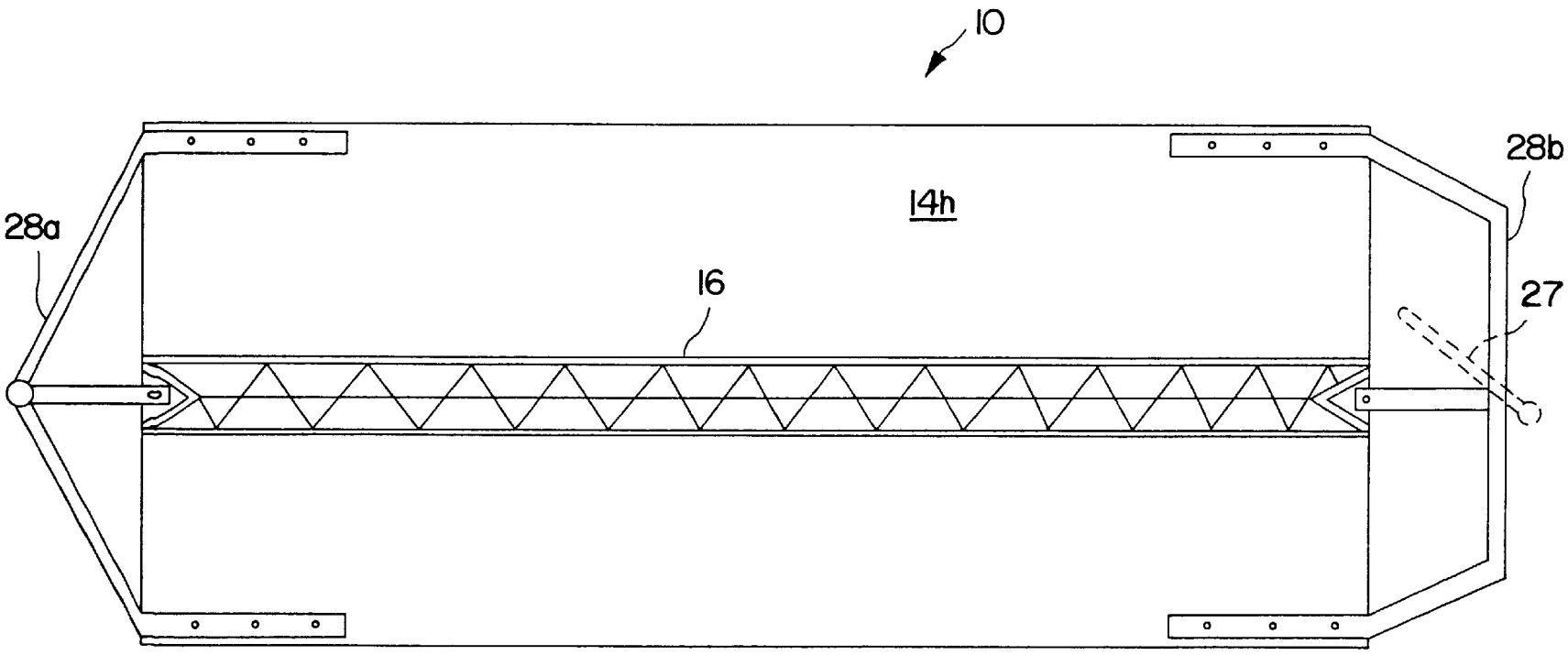
FIG. 5 is a plan view of the vessel of FIG. 4.

As shown in FIGS. 4 and 5, each marine vessel is preferably fitted with propulsion and steering means 27, and couplings 28*a*, 28*b* for towing and for linking a line of towed marine vessels in convoy each displaying a component of a composite advertising display.

Various changes may be made to the structure embodying the principles of the invention. The foregoing embodiments are set forth in an illustrative and not in a limiting sense. The scope of the invention is defined by the claims appended hereto.

I claim:

1. A marine vessel comprising spaced, generally parallel hull members, a deck structure surmounting the hull members to define a floating vessel, a reticular display frame fitted along the deck centerline having a vertical bowmast rising from the bow, a vertical sternmast rising from the stern, a top beam extending fore and aft between the tops of the bow and stern masts, and a deck beam interconnecting the bow and stern masts just above the deck, the base of each of the bowmast and sternmast being rigidly secured to the deck substructure, the display frame extending a considerable distance above water line and providing a substantial rectangular area for mounting an advertising display visible from port and starboard sides of the vessel, the top of the display frame having support rails for mounting a light system for illuminating an advertising display surface, the advertising display being within the display frame at an angle of from 90° to 120° with respect to the deck as an aid to better visibility at greater distances of the display from shore.

2. A marine vessel as defined in claim 1 which further includes means for propelling the vessel.

3. A marine vessel as defined in claim 1 which further includes means for steering the vessel.

4. A marine vessel as defined in claim 1 which further includes means for linking a plurality of vessels in convoy.

5. A marine vessel as defined in claim 1 which further includes means for stabilizing the vessel in a waterway.

* * * * *